US010322872B1

(12) United States Patent
Klinge et al.

(10) Patent No.: US 10,322,872 B1
(45) Date of Patent: Jun. 18, 2019

(54) MODULAR DOOR ASSEMBLY

(71) Applicant: Klinge Corporation, York, PA (US)

(72) Inventors: Allan Klinge, Lititz, PA (US); Henrik Klinge, York, PA (US)

(73) Assignee: Klinge Corporation, York, PA (US)

( * ) Notice: Subject to any disclaimer, the term of this patent is extended or adjusted under 35 U.S.C. 154(b) by 0 days.

(21) Appl. No.: 15/842,201

(22) Filed: Dec. 14, 2017

(51) Int. Cl.
*B65D 88/12* (2006.01)
*B65D 90/00* (2006.01)
*B65D 90/02* (2019.01)

(52) U.S. Cl.
CPC ..... *B65D 90/008* (2013.01); *B65D 88/121* (2013.01); *B65D 90/0026* (2013.01); *B65D 90/023* (2013.01)

(58) Field of Classification Search
CPC ..... B65D 90/008; B65D 90/023
USPC ..... 220/1.5, 1.6
See application file for complete search history.

(56) References Cited

U.S. PATENT DOCUMENTS 3,386,605 A * 6/1968 Lafont ..... B65D 90/047 220/1.5
3,951,284 A * 4/1976 Fell ..... B60P 3/00 141/10
4,799,607 A * 1/1989 Podd ..... B65D 88/54 105/279
5,524,781 A * 6/1996 Podd ..... B65D 90/046 220/1.5
5,547,331 A * 8/1996 Podd ..... B60P 1/60 141/10
7,288,192 B2 * 10/2007 Jowett ..... C02F 3/04 210/220
2009/0272024 A1 * 11/2009 Rogacki ..... A01M 13/003 43/125

FOREIGN PATENT DOCUMENTS

| | | |
|---|---|---|
| DE | 4412097 | 6/1995 |
| EP | 0517046 A1 | 12/1992 |
| WO | 2014088425 A1 | 6/2014 |
| WO | 2017083336 A1 | 5/2017 |

OTHER PUBLICATIONS

Notification, and the International Search Report and the Written Opinion of the International Searching Authority, or the Declaration, PCT/US2018/065707, dated Feb. 27, 2019, 11 pages.
Abstract of DE 4412097 C1, dated Jun. 14, 1995, 1 page.

* cited by examiner

*Primary Examiner* — Jeffrey R Allen
*Assistant Examiner* — Jennifer Castriotta
(74) *Attorney, Agent, or Firm* — Barley Snyder

(57) ABSTRACT

A modular door assembly is provided and includes a storage container and a modular door. The storage container includes a body defining an interior storage space, a door opening positioned at a door end of the body that is communication with the interior storage space, and a pair of container doors each secured to the door end of the body by a container door hinge. The container doors are movable between a container closed position to cover the door opening and a container open position allowing access therein. The modular door is removably attachable to the door end of the body and closes the door opening with the container doors in the open position.

15 Claims, 4 Drawing Sheets

MODULAR DOOR ASSEMBLY

FIELD OF THE INVENTION

The present invention relates to a modular door assembly and, more particularly, to a modular door assembly for a storage container.

BACKGROUND

Storage containers commonly used for shipping large quantities of goods are useful in a wide variety of applications given their size, portability, and durable construction. Such storage containers have a door end enclosed by a pair of hinged doors. Although the hinged doors reliably retain goods inside of the storage container, the doors do not form a reliably air-tight seal when closed.

Further, the hinged doors are cumbersome to open and close and, consequently, an interior of the storage container is exposed to an environment external of the storage container for a long duration each time a user accesses the interior of the storage container. The standard hinged doors of a storage container thus limit the usefulness of the storage container in applications in which an interior environment must be maintained, such as in the transport of goods requiring temperature or humidity control or the use of the storage container as an indoor space for workers in harsh environments.

SUMMARY

A modular door assembly is provided and includes a storage container and a modular door. The storage container includes a body defining an interior storage space, a door opening positioned at a door end of the body that is communication with the interior storage space, and a pair of container doors each secured to the door end of the body by a container door hinge. The container doors are movable between a container closed position to cover the door opening and a container open position allowing access therein. The modular door is removably attachable to the door end of the body and closes the door opening with the container doors in the open position.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
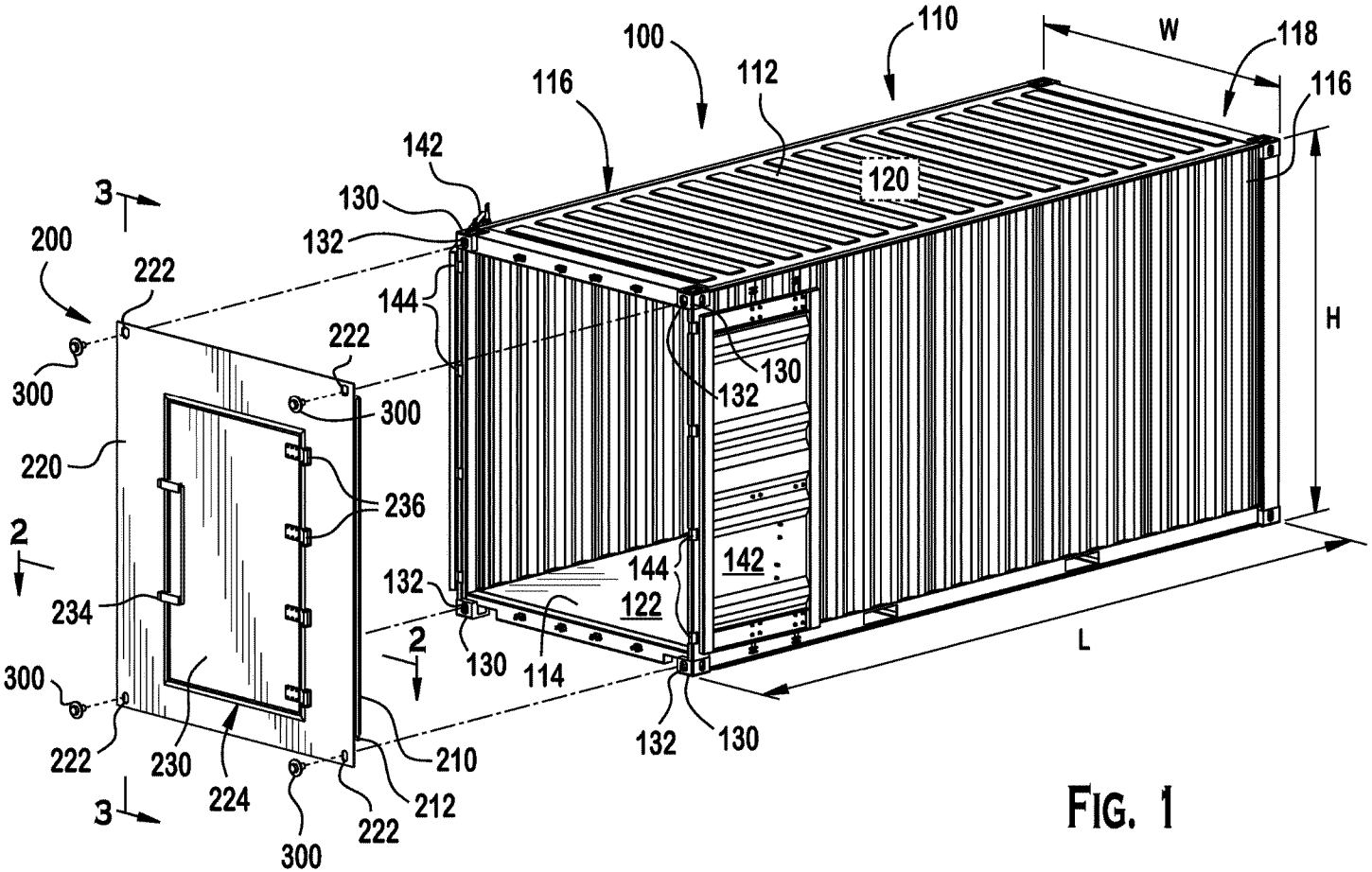
FIG. 1 is an exploded perspective view of a modular door assembly according to the invention.

Exemplary embodiments of the present invention will be described hereinafter in detail with reference to the attached drawings, wherein like reference numerals refer to like elements.

The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

A modular door assembly according to the invention is shown in FIG. 1. The modular door assembly generally includes a storage container 100 and a modular door 200.

The storage container 100 generally includes a body 110, a plurality of corner castings 130, and a pair of container doors 140. In the shown embodiment, the storage container 100 is a type of commonly available storage container known to those with ordinary skill in the art. In other embodiments, the storage container 100 may be any container capable of receiving the modular door 200 as described herein.

The body 110, as shown in FIG. 1, is formed as a rectangular parallelepiped with a top wall 112, a bottom wall 114, a pair of opposite side walls 116, and a panel 118. The top wall 112, bottom wall 114, side walls 116, and panel 118 define an interior storage space 120 within the body 110. In an embodiment, the panel 118 is a planar sheet removably attached to the top wall 112, bottom wall 114, and side walls 116 to define an end of the interior storage space 120. In other embodiments, the panel 118 may be formed of a refrigeration unit or any other element known to those with ordinary skill in the art capable of enclosing an end of a storage container body 110.

A door end of the body 110 opposite the panel 118 is open to an exterior of the body at a door opening 122. The door opening 122 communicates with the interior storage space 120. The body 110 may be formed from a metal such a steel, including COR-TEN or stainless steel, or aluminum, or may be formed of FRP (Fiberglass Reinforced Plastic) or other composite material. The body 110 may alternatively be formed from any other material used in storage containers known to those with ordinary skill in the art.

The plurality of corner castings 130, as shown in FIG. 1, are disposed on the body 110 around the door opening 122. The embodiment shown in FIG. 1 includes four corner castings 130. One corner casting 130 is disposed at each of the four intersections of the top wall 112 and bottom wall 114 with the side walls 116 around the door opening 122. The corner castings 130 protrude from a surface of the top wall 112, bottom wall 114, and side walls 116 about the door opening 122 along a longitudinal direction L of the body 110. The corner castings 130 do not overlap the door opening 122. Each of the corner castings 130, as shown in FIG. 1, has a container fastener receiving passageway 132 extending through the corner casting 130 in the longitudinal direction L. Each corner casting 130 may be formed from a metal such a steel, including COR-TEN or stainless steel, or aluminum, or may be formed of a composite material. The corner casting 130 may alternatively be formed from any other material used in corner castings of storage containers known to those with ordinary skill in the art. In an embodiment of the invention, each corner casting 130 meets the standard ISO 1161 of the International Organization for Standardization for steel container corner castings.

Each of the pair of container doors 140, as shown in FIG. 1, includes a container door panel 142 and a container door hinge assembly 144. The container door panel 142 is a planar sheet and is sized to fit over half of the door opening 122 such that the container door panels 142 of the pair of container doors 140 can fully enclose the door opening 122. The container door panel 142 may be formed from a metal such a steel, including COR-TEN or stainless steel, or aluminum, or may be formed of FRP (Fiberglass Reinforced Plastic) or other composite material. The container door panel 142 may alternatively be formed from any other material used in storage containers known to those with ordinary skill in the art.

Each container door panel 142 is permanently connected to one side wall 116 of the body 110 at a door end of the side wall 116 adjacent the door opening 122 by one container door hinge assembly 144. The container door hinge 144 permits the container door panel 142 to move with respect to the body 110 between a container closed position, in which the container doors 140 are positioned to extend along a width direction W transverse to the longitudinal direction L and abut the top wall 112, bottom wall 114, and side walls 116 to fully enclose the door opening 122, and a container open position, in which the container doors 140 extend substantially along the longitudinal direction L and abut the side wall 116, exposing the door opening 122. As in known storage containers, in the container closed position, the container doors 140 are capable of being secured in place by an attachment mechanism The container doors 140 are shown at a position between the container closed position and the container open position in FIG. 1 and are shown in the container open position in FIG. 2.

In the shown embodiment, the container door hinge 144 includes one or more known hinges and, more particularly, a plurality of known swing door hinges that secure to the sidewall 116 and door panel 142. One skilled in the art should appreciate that other known hinged systems can be used to allow the door panel 142 to pivot from a closed position to an open position up against the sidewall 116, as shown in FIG. 2.

Figure 2:
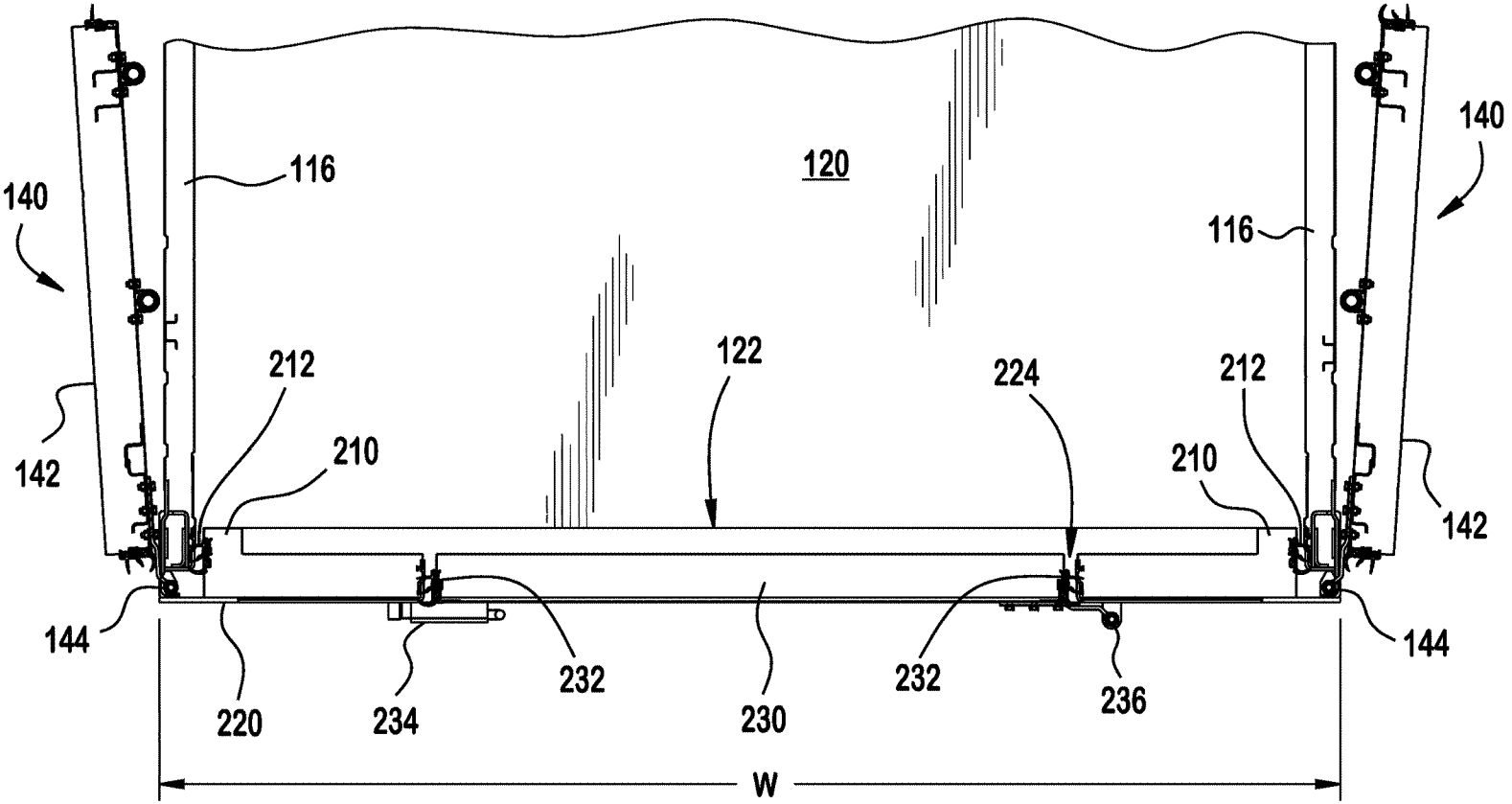
FIG. 2 is a top sectional view of a storage container and a modular door according to the invention.

According to an embodiment of the invention, a modular door 200, as shown in FIGS. 1 and 2, generally includes a frame 210, an outer panel 220, and a door panel 230. The frame 210, the outer panel 220, and the door panel 230 may be manufactured from a metal, such a steel, including COR-TEN or stainless steel, or aluminum, or may be formed of FRP (Fiberglass Reinforced Plastic) or other composite material. The elements of the modular door 200 may alternatively be formed from any other material used in storage containers known to those with ordinary skill in the art.

The outer panel 220 is a planar sheet member sized to cover the plurality of corner castings 130. In the shown embodiment, the outer panel 220 is square shaped to match the shape of the storage container 100 on the door end having the door opening 122. In other embodiments, in which the storage container 100 has other shapes, the outer panel 220 is shaped to fit an end of the storage container 100 and similarly cover the corner castings 130. The outer panel 220 includes a plurality of modular door fastener receiving passageways 222 and a door panel passageway 224 extending through the outer panel 220. The modular door fastener receiving passageways 222 are positioned about a perimeter of the outer panel 220 and, in the shown embodiment, are disposed at each of the four corners of the square-shaped outer panel 220. The door panel passageway 224 is generally centrally positioned about the outer panel 220.

The frame 210, as shown in FIGS. 1 and 2, extends from an interior side of the outer panel 220 and around the door panel passageway 224. The frame 210 is sized to fit in the door opening 122 of the body 110 and, consequently, is spaced from the outer edges of the outer panel 220; the frame 210 has a smaller perimeter than the outer panel 220. The frame 210 includes a frame gasket 212 extending around an outer perimeter of the frame 210.

The door panel 230, as shown in FIGS. 1 and 2, is positioned in the door panel passageway 224 of the outer panel 220. The door panel 230 is permanently connected to the outer panel 220 by a modular door hinge assembly 236. A handle 234 is disposed on an exterior side of the door panel 230 opposite the interior side of the outer panel 220 and a door panel gasket 232 extends around an outer perimeter of the door panel 230. To move the door panel 230, a user grasps the handle 234 and rotates the door panel 230 about an axis extending along a height direction H perpendicular to the longitudinal direction L and the width direction W between a door closed position, in which the door panel 230 is flush with the outer panel 220 as shown in FIG. 1, and a door open position permitting access through the modular door 200. The door panel gasket 232 is compressed between the door panel 230 and the frame 210 in the door closed position, as shown in FIG. 2, sealing the interior side of the modular door 200 from the exterior side of the modular door 200.

Figure 3:
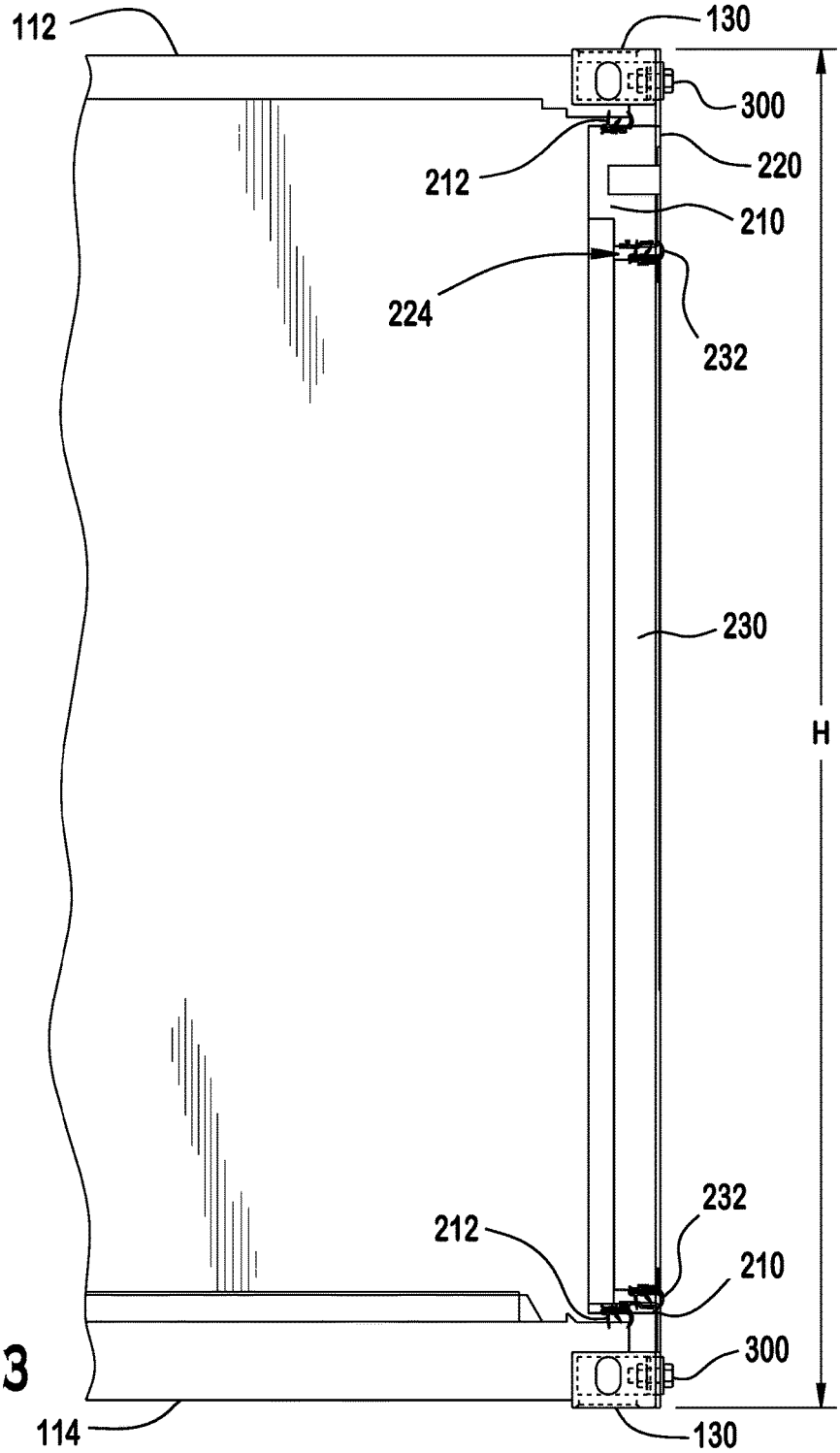
FIG. 3 is a side sectional view of the storage container and the modular door.

The modular door 200, as will be described below with reference to FIGS. 1-3, is removably attachable to the door end of the storage container 100 having the door opening 122 to seal the interior storage space 120 without removing the container doors 140. The modular door 200 is shown attached to the storage container 100 in FIGS. 2 and 3.

The container doors 140 are first moved from the container closed position to the container open position shown in FIG. 2 in which the container doors 140 abut the side walls 116 and expose the door opening 122. The frame 210 of the modular door 200 is then inserted into the door opening 122 of the storage container 100 along the longitudinal direction L until the outer panel 220 abuts the corner castings 130, as shown in FIGS. 2 and 3. The modular door 200 is capable of being inserted into the door end of the storage container 100 without abutting or otherwise interfering with the open container doors 140. When the modular door 200 is positioned at the door end of the storage container 100, the door opening 122 is closed. The outer panel 220 covers an entire width of the body 110 at the door end in the width direction W, as shown in FIG. 2, and covers an entire height of the body 110 at the door end in the height direction H, as shown in FIG. 3.

A plurality of removable fasteners 300 shown in FIGS. 1 and 3 are positioned to extend through the modular door fastener receiving passageways 222 and the container fastener receiving passageways 132 to removably attach the outer panel 220 to the corner castings 130 and secure the modular door 200 to the storage container 100. In an embodiment, the removable fasteners 300 are threaded bolts that is positioned through a modular door fastener receiving passageway 222 and then engages with a threaded nut (not shown) positioned in corner casting 130. In other embodiments, the removable fasteners 300 may be a latch, screw, or any other removable fastener known to those with ordinary skill in the art. In yet another embodiment, the threaded modular door fastener receiving passageway 222 is a threaded passageway that engages with the fastener 300 for a secure fit. support. In yet another embodiment of the invention, the corner casting 130 includes a threaded container fastener receiving passageway 132 that engages the fastener 300 in order to secure a corner of the modular door 200 with the container 100.

When the modular door 200 is removably attached to the storage container 100, as shown in FIGS. 2 and 3, an entire perimeter of the frame gasket 212 is compressed between the frame 210 and the top wall 112, the bottom wall 114, and the side walls 116, sealing the interior storage space 120 from an area exterior of the modular door assembly. To access the interior storage space 120 with the modular door 200 attached to the storage container 100, a user grasps the handle 234 and moves the door panel 230 between the closed position and the open position of the door panel 230. The door panel gasket 232 is compressed between the door panel 230 and the frame 210 in the closed position, as shown in FIG. 2, sealing the interior side of the modular door 200 from the exterior side of the modular door 200.

The modular door 200 fully seals the interior storage space 120 of the storage container 100, while permitting access via the door panel 230, without requiring removal of the container doors 140. In an embodiment, a refrigeration unit (not shown) may be used to set an atmosphere in the interior storage space 120 and the modular door 200 provides a seal for the door opening 122 to more efficiently control that environment of the interior storage space 120. The modular door 200 may be used to seal a temperature and/or humidity-controlled interior storage space 120 in military applications, transport or storage of temperature-sensitive pharmaceuticals, oil, gas, and other chemicals, or any other applications known to those with ordinary skill in the art.

Figure 4:
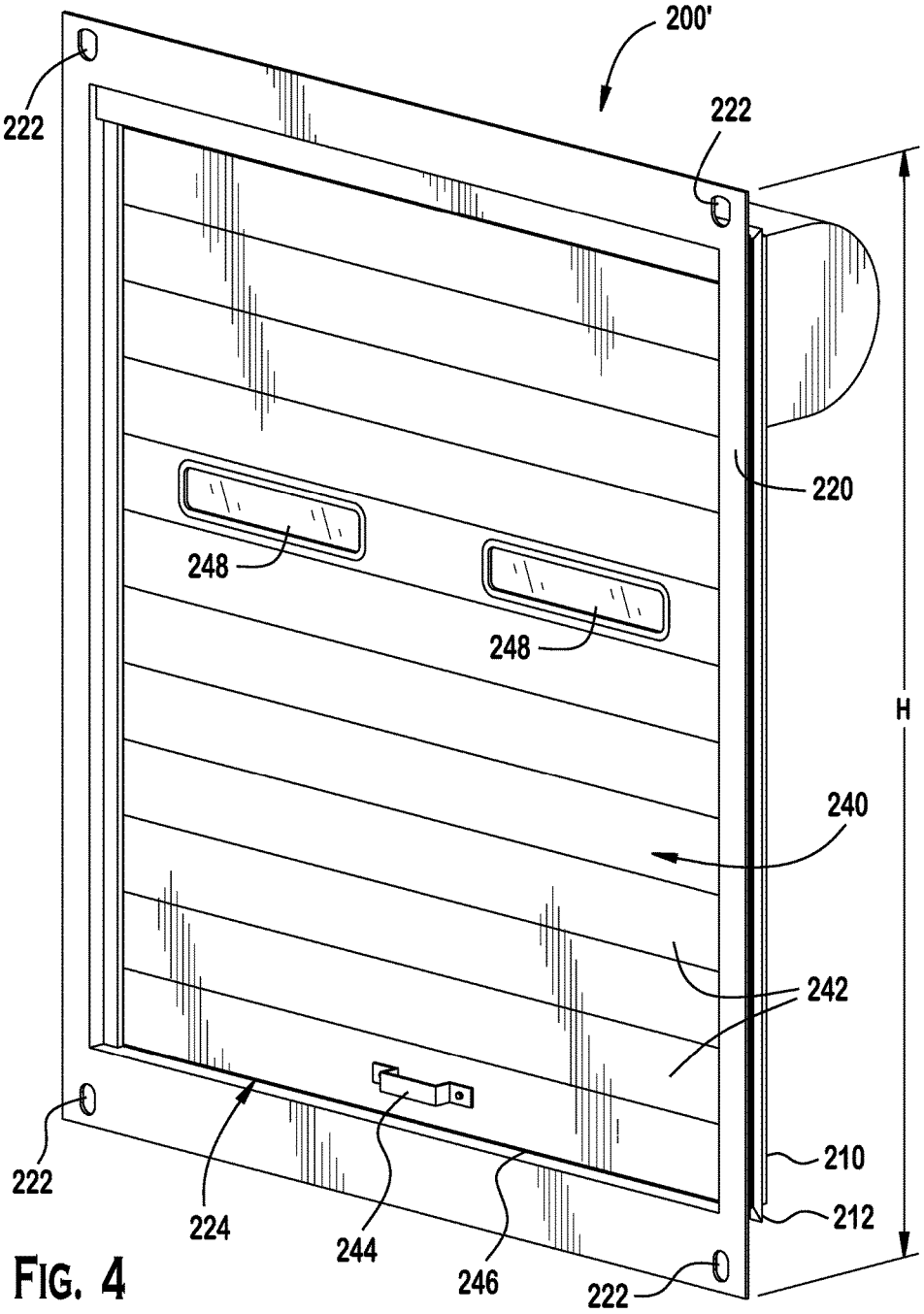
FIG. 4 is a perspective view of a modular door according to another embodiment of the invention.

A modular door 200' according to another embodiment of the invention is shown in FIG. 4. Like reference numbers indicate like elements and only the differences with respect to the modular door 200 shown in FIGS. 1-3 will be described in detail.

The modular door 200', as shown in FIG. 4, includes a frame 210, an outer panel 220, and a door panel 240. The door panel 240 is positioned in the door panel passageway 224 of the outer panel 220. The door panel 240 has a plurality of door sections 242 hinged together and movable together; as is known in sectional doors, the door sections 242 are permanently disposed within the door panel passageway 224 of the outer panel 220 and are movable along a plurality of rollers (not shown) in the height direction H. A handle 244 is disposed on an exterior side of the door panel 240 opposite the interior side of the outer panel 220 and a door panel gasket 246 extends around an outer perimeter of the door panel 240. In an embodiment, a plurality of windows 248 are disposed on the door sections 242 to permit the passage of light through the door panel 240.

To move the door panel 240, a user grasps the handle 244 and moves the door sections 242 along the height direction H between a closed position, in which the door panel 240 fully encloses the door panel passageway 224 as shown in FIG. 4, and an open position permitting passage of the user through the modular door 200'. The door panel gasket 246 is compressed between the door panel 240 and the frame 210 in the closed position, as shown in FIG. 4, sealing the interior side of the modular door 200' from the exterior side of the modular door 200'. The modular door 200' is removably attached to the door end of the storage container 100 having the door opening 122 to seal the interior storage space 120 in the same way as the modular door 200 described above. The modular door 200' thus also fully seals the interior storage space 120 of the storage container 100, while permitting access via the door panel 240, without requiring removal of the container doors 140.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range.

What is claimed is:

1. A modular door assembly, comprising:

a storage container having:

a body with a top wall, a bottom wall positioned opposite the top wall, a pair of opposite side walls extending between the top wall and the bottom wall, and a panel connecting the top wall, the bottom wall, and the pair of opposite side walls to define an interior storage space and a door opening disposed at a door end of the body and in communication with the interior storage space; and a pair of container doors having a container door hinge assembly secured to the pair of opposite side walls and movable between a container closed position covering the door opening and a container open position permitting access to the interior storage space; and a modular door removably attachable to the body and covering the door opening with the pair of container doors in the container open position, the modular door having an outer panel with a plurality of modular door fastener receiving passageways and a door panel passageway extending through the outer panel.

2. The modular door assembly of claim 1, wherein the modular door includes a door panel disposed in the door panel passageway and movable with respect to the outer panel between a door open position and a door closed position.

3. The modular door assembly of claim 2, wherein the door panel is rotatably secured to the outer panel by a modular door hinge.

4. The modular door assembly of claim 2, wherein the door panel includes has a plurality of door sections hinged together and is movable along a height direction.

5. The modular door assembly of claim 2, wherein the modular door includes a frame extending from an interior side of the outer panel around the door panel passageway.

6. The modular door assembly of claim 5, wherein the modular door seals the interior storage space.

7. The modular door assembly of claim 6, wherein the frame includes a frame gasket extending around an outer perimeter of the frame.

8. The modular door assembly of claim 7, wherein the frame gasket is compressed between the frame and the top wall, the bottom wall, and the pair of side walls when the modular door is attached to the storage container.

9. The modular door assembly of claim 6, further comprising a door panel gasket extending around an outer perimeter of the door panel between the door panel and the frame.

10. The modular door assembly of claim 1 wherein the storage container further includes a plurality of corner castings disposed around the door opening.

11. The modular door assembly of claim 10, wherein each modular door fastener receiving passageway is positioned about a perimeter of the outer panel.

12. The modular door assembly of claim 10, wherein each of the plurality of corner castings includes a container fastener receiving passageway extending through each corner casting of the plurality of the corner castings.

13. The modular door assembly of claim 12, further comprising a plurality of removable fasteners positioned to extend through each modular door fastener receiving passageway and each container fastener receiving passageway to removably attach the modular door to the body.

14. The modular door assembly of claim 10, wherein the outer panel abuts the plurality of corner castings.

15. The modular door assembly of claim 14, wherein the outer panel covers an entire width of the body at the door end in a width direction and covers an entire height of the body at the door end in a height direction.

* * * * *